US009972463B2

(12) United States Patent
Oshima

(10) Patent No.: US 9,972,463 B2
(45) Date of Patent: May 15, 2018

(54) ELECTRONIC DEVICE, PRINTING DEVICE AND ELECTRONIC DEVICE PRODUCTION METHOD

(71) Applicant: CASIO COMPUTER CO., LTD., Shibuya-ku, Tokyo (JP)

(72) Inventor: Kouji Oshima, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days. days.

(21) Appl. No.: 15/080,015

(22) Filed: Mar. 24, 2016

(65) Prior Publication Data

US 2016/0293357 A1 Oct. 6, 2016

(30) Foreign Application Priority Data

Apr. 6, 2015 (JP) ..... 2015-077511

(51) Int. Cl.
*H01H 13/705* (2006.01)

(52) U.S. Cl.
CPC ..... *H01H 13/705* (2013.01); *H01H 2221/002* (2013.01); *H01H 2223/034* (2013.01); *H01H 2223/04* (2013.01)

(58) Field of Classification Search
CPC ..... H01H 13/705; H01H 2223/034; H01H 2221/002; H01H 2223/04; B41J 3/36; B41J 3/39
See application file for complete search history.

(56) References Cited

U.S. PATENT DOCUMENTS

| | | | | |
|---|---|---|---|---|
| 8,772,653 | B2 | 7/2014 | He et al. | |
| 2012/0018288 | A1* | 1/2012 | Rollet | G06F 21/83 200/5 A |

FOREIGN PATENT DOCUMENTS

| | | | |
|---|---|---|---|
| CN | 101697182 | A | 4/2010 |
| JP | 05284085 | A | 10/1993 |
| JP | 55058685 | U | 10/1993 |
| JP | 06084429 | A | 3/1994 |
| JP | 06070131 | U | 9/1994 |
| JP | 07295705 | A | 11/1995 |
| JP | 2000011809 | A | 1/2000 |
| JP | 2003243822 | A | 8/2003 |

(Continued)

OTHER PUBLICATIONS

Chinese Office Action (and English translation thereof) dated Oct. 27, 2017, issued in counterpart Chinese Application No. 201610206213.9.

(Continued)

*Primary Examiner* — Alessandro Amari
*Assistant Examiner* — Roger W Pisha, II
(74) *Attorney, Agent, or Firm* — Holtz, Holtz & Volek PC

(57) ABSTRACT

An electronic device includes a pressing member having plural protruding pressing parts, a first opening-formed member having plural first openings into which the plural pressing parts are inserted so as to individually protrude, a second opening-formed member having plural second openings into which the plural pressing parts are inserted so as to individually protrude, and a positioning member positioning the pressing member, first opening-formed member, and second opening-formed member so that the plural pressing parts are disposed at positions where the plural pressing parts are inserted in the plural first openings and plural second openings.

12 Claims, 10 Drawing Sheets

(56) References Cited

FOREIGN PATENT DOCUMENTS

| | | | |
|---|---|---|---|
| JP | 2009135714 | A | 6/2009 |
| JP | 5477308 | B2 | 4/2014 |

OTHER PUBLICATIONS

Japanese Office Action dated Dec. 12, 2017 issued in counterpart Japanese Application No. 2015-077511.

* cited by examiner

ELECTRONIC DEVICE, PRINTING DEVICE AND ELECTRONIC DEVICE PRODUCTION METHOD

CROSS-REFERENCE TO RELATED APPLICATION

This application claims the benefit of Japanese Patent Application No. 2015-077511, filed on Apr. 6, 2015, the entire disclosure of which is incorporated by reference herein.

FIELD

This application relates generally to an electronic device, printing device, and electronic device production method.

BACKGROUND

Electronic devices having protruding pressing parts such as input keys receiving input by pressing operations, printing devices, and methods producing such electronic devices are known.

For example, Japanese Patent No. 5477308 discloses an input device (tape printing device) having plural key caps to be pressed. In more detail, the input includes a body enclosure having plural through-holes into which plural key caps are individually inserted. Then, in this input device, all key caps protrude by a specific amount with reference to the enclosure surface even if the key arrangement surface formed on the body enclosure is curved so that a user can operate the keys without experiencing awkward feelings.

For the above described electronic devices having protruding pressing parts, printing devices, and methods of producing the electronic devices, it is important that a member having protruding pressing parts and members having openings (through-holes) into which the pressing parts are inserted are positioned with excellent accuracy. If those members are not positioned with excellent accuracy, not only are the pressing parts not inserted into the openings for assembling the device, but also even if the pressing parts are inserted into the openings and the device is assembled, contact friction between the pressing parts and openings during pressing operations causes some damage to the device.

Particularly, when a pressing part is inserted into plural openings formed in plural different members, not into one opening, three or more members, a member having pressing parts and plural members having openings into which the pressing parts are inserted, have to mutually be positioned with excellent accuracy. Therefore, the accuracy of positioning is more important.

The present disclosure is made for solving the above problem and an objective of the disclosure is to provide an electronic device, printing device, electronic device production method in which a member having protruding pressing parts and plural members having openings into which the pressing parts are inserted are positioned with excellent accuracy.

SUMMARY

In order to achieve the above objective, a mode of the electronic device, printing device, and electronic device production method according to the present disclosure includes:

a pressing member including plural protruding pressing parts;

a first opening-formed member including plural first openings in which the plural pressing parts are so inserted as to individually protrude;

a second opening-formed member including plural second openings in which the plural pressing parts inserted from the plural first openings are so inserted as to individually protrude; and at least one positioning member positioning the pressing member, first opening-formed member, and second opening-formed member so that the plural pressing parts are disposed at positions where the plural pressing parts are inserted in the plural first openings and plural second openings.

The present disclosure can provide an electronic device, printing device, electronic device production method in which a member having protruding pressing parts and plural members having openings into which the pressing parts are inserted are positioned with excellent accuracy.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

A more complete understanding of this application can be obtained when the following detailed description is considered in conjunction with the following drawings, in which.

DETAILED DESCRIPTION

An embodiment of the present disclosure will be described hereafter with reference to the drawings. In the figures, the same or corresponding components are referred to by the same reference numbers.

In the embodiment below, a printing device (label printer) is described as the electronic device according to the present disclosure by way of example.

Figure 1A:
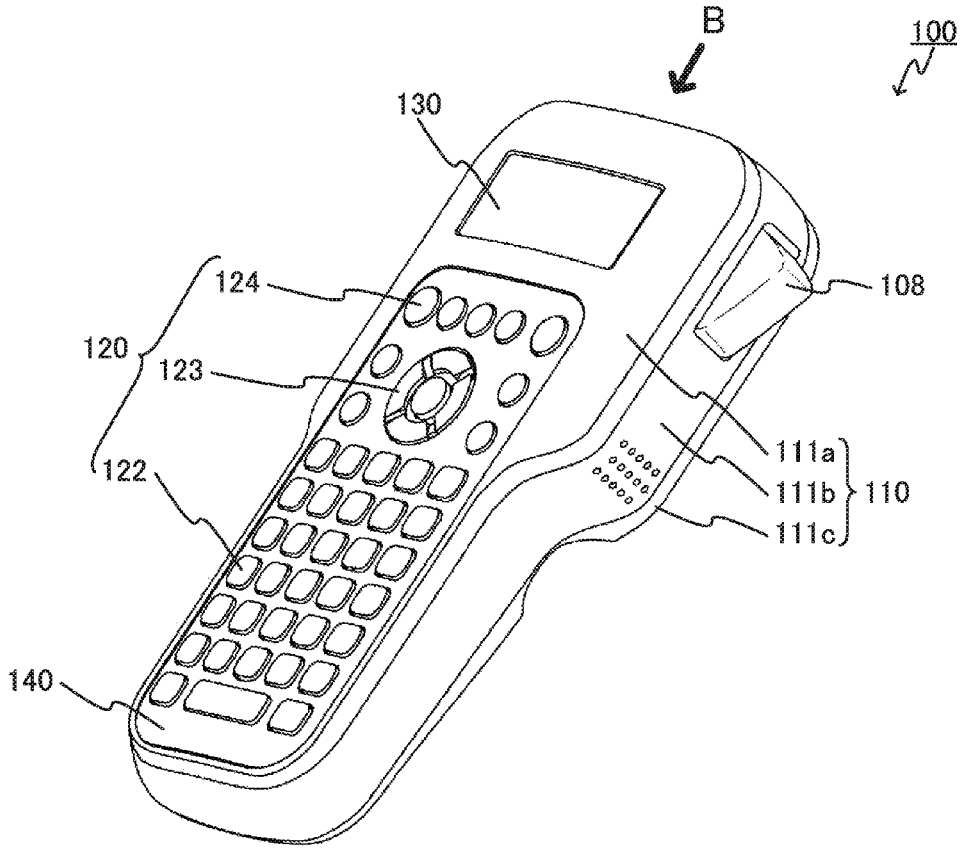
FIG. 1A is a perspective external view of a printing device according to an embodiment of the present disclosure.
Figure 1B:
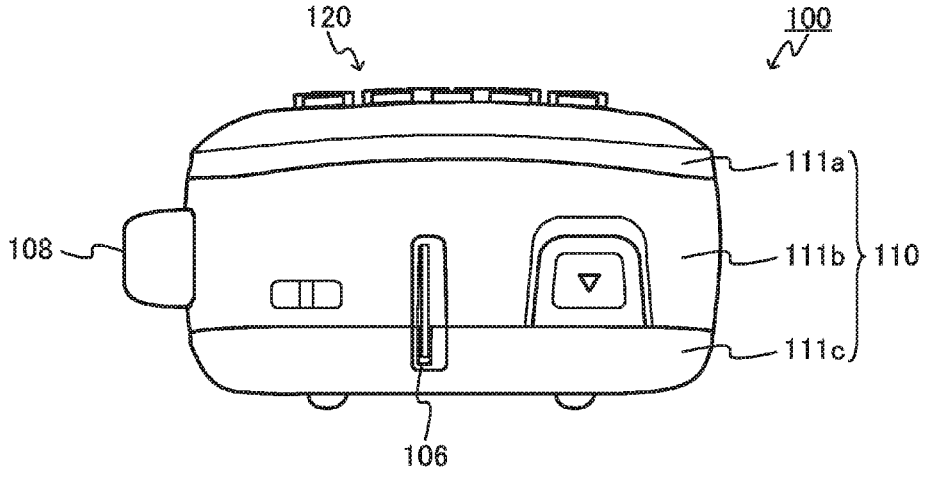
FIG. 1B is a side view of the printing device seen in the direction of an arrow B shown in FIG. 1A.
Figure 2A:
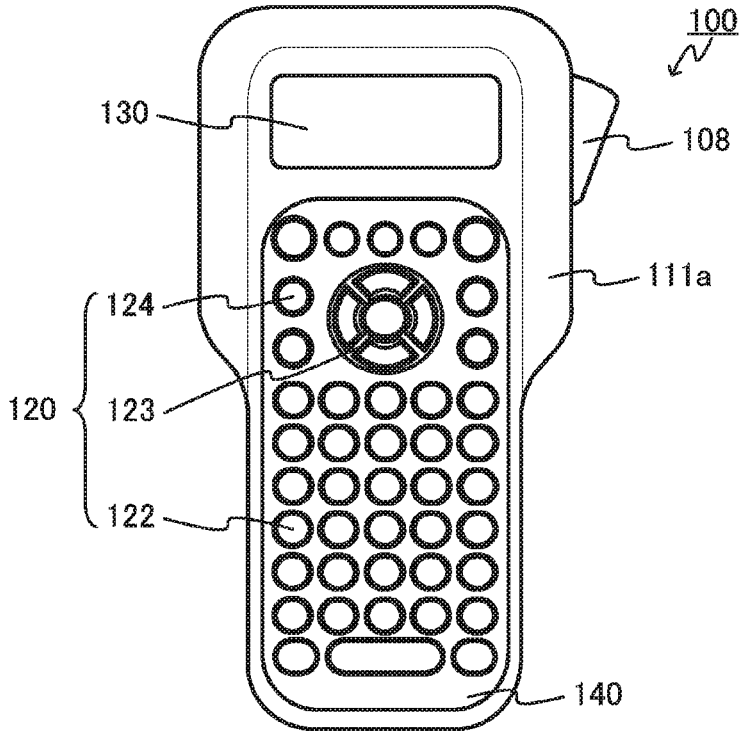
FIG. 2A is a plane view of the printing device according to the embodiment of the present disclosure.
Figure 2B:
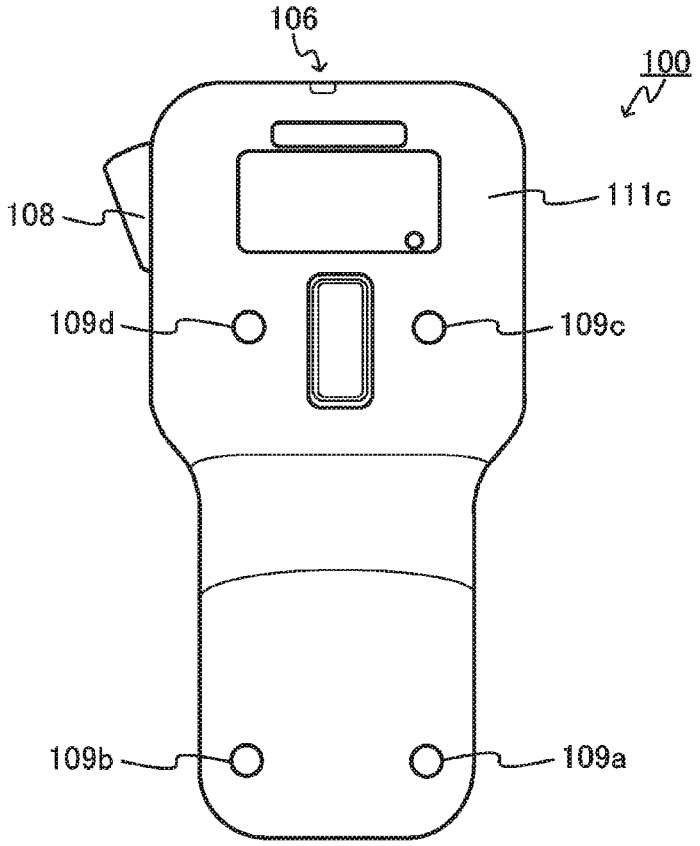
FIG. 2B is a bottom view of the printing device according to the embodiment of the present disclosure.

FIG. 1A shows a perspective external view of a printing device 100 according to an embodiment of the present disclosure. FIG. 1B shows a side view of the printing device 100 (the side seen in the direction of an arrow B in FIG. 1A). Moreover, FIGS. 2A and 2B show a front view and back view of the printing device 100, respectively.

The printing device 100 is a compact label printer small enough for a user to hold in one hand. The printing device 100 prints print patterns including graphic, character, and other patterns on a printing medium that is a tape material formed by laminating a printing tape having a printing surface on the front and an adhesive surface on the back and a releasable tape attached to the adhesive surface.

The printing device 100 includes a synthetic resin enclosure 110 constructed by combining three cases, an upper case 111*a*, a middle case 111*b*, and a lower case 111*c*. The enclosure 110 houses a thermal head, printed wiring board, and the like, which will be descried later. The enclosure 110 is narrower and thinner in the lower part than in the upper part in the longitudinal direction so that the user can easily hold the lower part in the longitudinal direction. Thus, the user can enter a desired print pattern and print the pattern on the tape material while holding the printing device 100.

Moreover, the printing device 100 includes an inputter 120 and a display 130 on the front side of the upper case 111*a*.

The inputter 120 includes plural rubber press keys 122, 123, and 124 functioning as input keys.

The press keys 122 are character input keys arranged nearly in the lower half region of the upper case 111*a* in the longitudinal direction for the user to enter character data. The press keys 122 are arranged in a two-dimensional array (a grid) of seven horizontal rows and five vertical columns (except for three columns in the lowermost row) as shown in FIGS. 1A and 2A. The press keys 123 are keys including four cursor keys arranged in a circle in the center region of the upper case 111*a* and a circular enter key surrounded by these four cursor keys. The four cursor keys are keys for moving a cursor on the display screen of the display 130 and the enter key is the key for selecting an item on which the cursor is placed. The press keys 124 are control keys arranged around the press keys 123 functioning as the cursor keys and enter key for setting the print modes and conducting various setting operations. Operating the press keys 122, 123 and 124 of the inputter 120, the user can enter, for example, characters to print on a tape material, commands for print start and/or setting changes, and the like.

The display 130 includes a display screen such as a liquid crystal display panel as a main panel of the printing device 100. The display 130 displays, for example, information regarding entered data (images, a selection menu for various settings, messages regarding various operations, and the like).

Moreover, the printing device 100 includes a key cover 140 in the portion of the upper case 111*a* where the inputter 120 is provided. The key cover 140 is a synthetic resin member covering the surface of the upper case 111*a* in part for the purpose of improving the printing device 100 in strength and design (industrial design).

Plural openings corresponding to the plural press keys 122, 123, and 124 are formed in the key cover 140 and upper case 111*a* as described in detail later. The plural press keys 122, 123, and 124 are individually inserted into the openings formed in the upper case 111*a* and the openings formed in the key cover 140 and slightly protrude from the openings of the key cover 140 so that the user can easily press the press keys 122, 123, and 124. A large opening into which the plural press keys 122, 123, and 124 are inserted all together may be formed in the upper case 111*a*, instead of plural openings corresponding to the plural press keys 122, 123, and 124 on a one-to-one basis. In such a case, the strength of the upper case 111*a* is lowered.

As shown in FIG. 1B, the printing device 100 includes a tape dispenser 106 from which the printed tape material is dispensed on a side of the enclosure 110 (the side seen in the direction of the arrow B in FIG. 1A). Moreover, the printing device 100 includes a cutter operation lever 108 for cutting the tape material on which a print pattern is printed on a side of the enclosure 110 (the right side when the user squarely faces the front of the upper case 111*a*).

As shown in FIG. 2B, the printing device 100 includes four protrusions 109*a* to 109*d* on the back (the lower case 111*c*) so that the printing device 100 is stably placed on a table or the like. Moreover, although not shown, the printing device 100 comprises a power switch for switching the printing device 100 between power-on and power-off, power supply terminals to which a power code is connected, terminals for connecting to an external device such as a personal computer, a slot into which a storage medium such as a memory card is inserted, and the like.

Figure 3A:
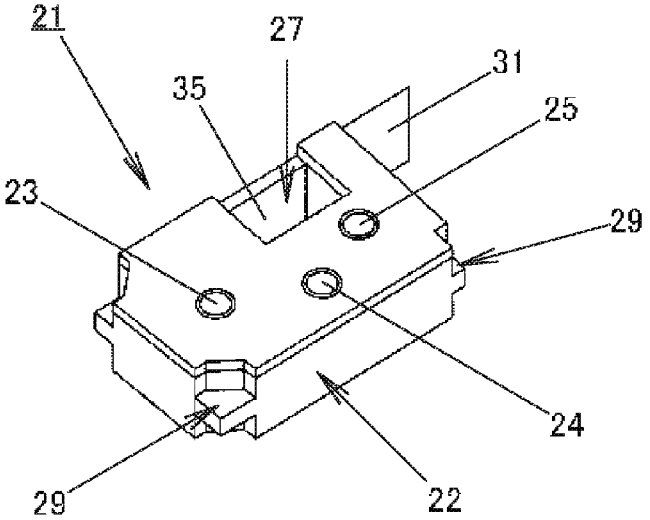
FIG. 3A is a perspective external view of a tape cassette.

FIG. 3A shows the appearance of a tape cassette 21 used with the printing device 100. Moreover, FIG. 3B shows a perspective view of a part of the internal structure of the printing device 100.

Figure 3B:
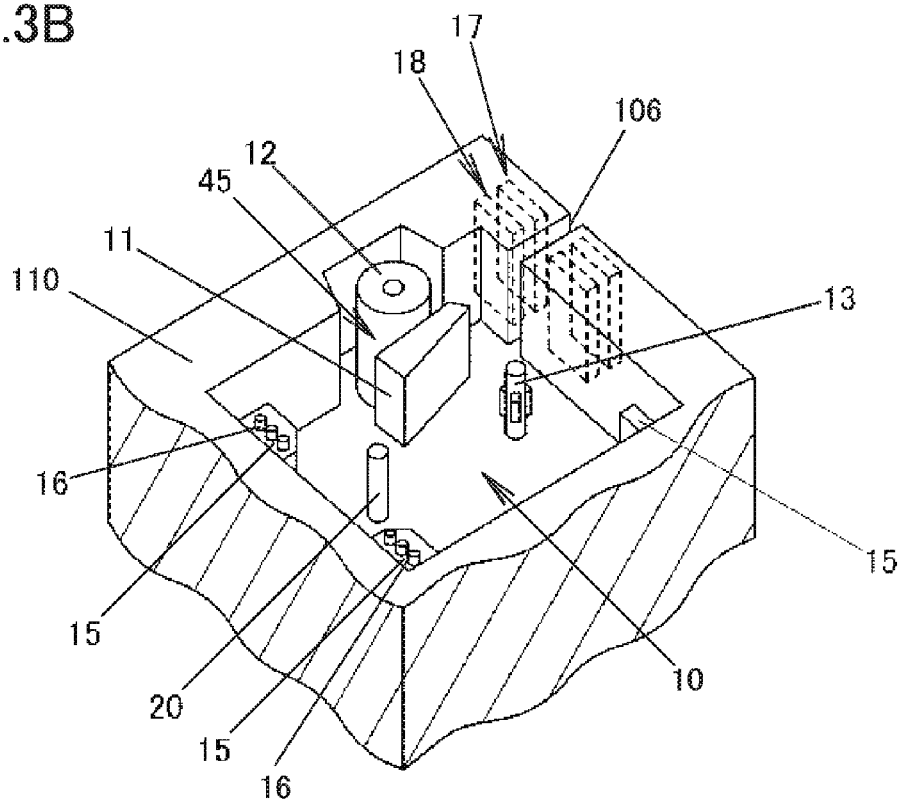
FIG. 3B is an enlarged internal view of the printing device according to the embodiment of the present disclosure.

As shown in FIG. 3B, a tape housing 10 for housing (loading) the tape cassette 21 containing a tape material 31 and an ink ribbon 35 is formed inside the enclosure 110. A printing mechanism 45 as a printer and cassette receivers 15 for supporting the tape cassette 21 at a given position are formed inside the tape housing 10.

The printing mechanism 45 includes printing elements arranged in the vertical direction, a print head (thermal head) 11, a platen roller 12 clamping and transferring the tape material 31 and ink ribbon 35 together with the print head 11, a positioning shaft 20 engaging with and positioning the tape cassette 21, and a ribbon take-up shaft 13 taking up the ink ribbon 35 used for printing into the tape cassette 21. The printing mechanism 45 prints a print pattern regarding data entered from the inputter 120 on a printing medium.

Moreover, the tape dispenser 106 leading to the outside of the enclosure 110 is formed at one end of the tape housing 10. A full-cut mechanism 17 as full-cut means for cutting the printing tape and releasable tape of the tape material 31 crosswise and a half-cut mechanism 18 as half-cut means for cutting only the printing tape of the tape material 31 and leaving the releasable tape uncut are installed in the tape dispenser 106.

FIG. 3A shows the appearance of the tape cassette 21 used with the printing device 100. The tape cassette 21 includes a cassette casing 22. A tape core 23 around which the tape material 31 is wound, a ribbon feed core 24 around which an unused ink ribbon 35 is wound, and a ribbon take-up core 25 taking up the used ink ribbon 35 are each housed in the cassette casing 22. Moreover, a head positioner 27 in which the print head 11 is positioned when the tape cassette 21 is loaded in the tape housing 10 is formed in the cassette casing 22 of the tape cassette 21.

Engagees 29 engaging with the cassette receivers 15 of the tape housing 10 and supported by the cassette receivers 15 are formed at the corners of the cassette casing 22. Then, not-shown given uneven surfaces are formed on the engagees 29 of the cassette casing 22 in accordance with the type of the tape cassette 21, and given tape width detection switches 16 determining the uneven surfaces formed on the engagees 29 of the cassette casing 22 when the tape cassette 21 is loaded are formed on the cassette receivers 15 of the tape housing 10.

In the printing device 100, as the tape cassette 21 is loaded in the tape housing 10, some or all of the engagees 29 of the cassette casing 22 and the tape width detection switches 16 formed on the cassette receivers 15 of the tape housing 10 engage and the engaged tape width detection switches 16 are pressed down. The printing device 100 determines the type of the tape cassette 21 such as the tape width according to the combination of the tape width detection switches 16 turned on.

In other words, since the type of the tape cassette 21 varies depending on the width and the like of the contained tape material 31, the printing device 100 determines the type of the tape cassette 21 to identify the width, color, and the like of the tape that is the printing target, and creates print data suitable for the tape width.

As the printing is ordered, the tape material 31 and ink ribbon 35 are dispensed from the tape cassette 21. The tape material 31 and ink ribbon 35 are clamped and transferred between the platen roller 12 and print head 11 in the laminated state.

Then, the print head 11 is thermally activated based on the print data so that the ink of the ink ribbon 35 is heat-transferred to the printing tape of the tape material 31 for printing. As the printing ends, the user operates the cutter operation lever 108 to activate the full-cut mechanism 17 or half-cut mechanism 18 so as to cut the tape material 31 crosswise and create a piece of tape-like label.

The configurations of the upper case 111*a* and other members fixed together with the upper case 111*a* such as the key cover 140 in the printing device 100 having the above-described configuration will be described in detail hereafter.

Figure 4:
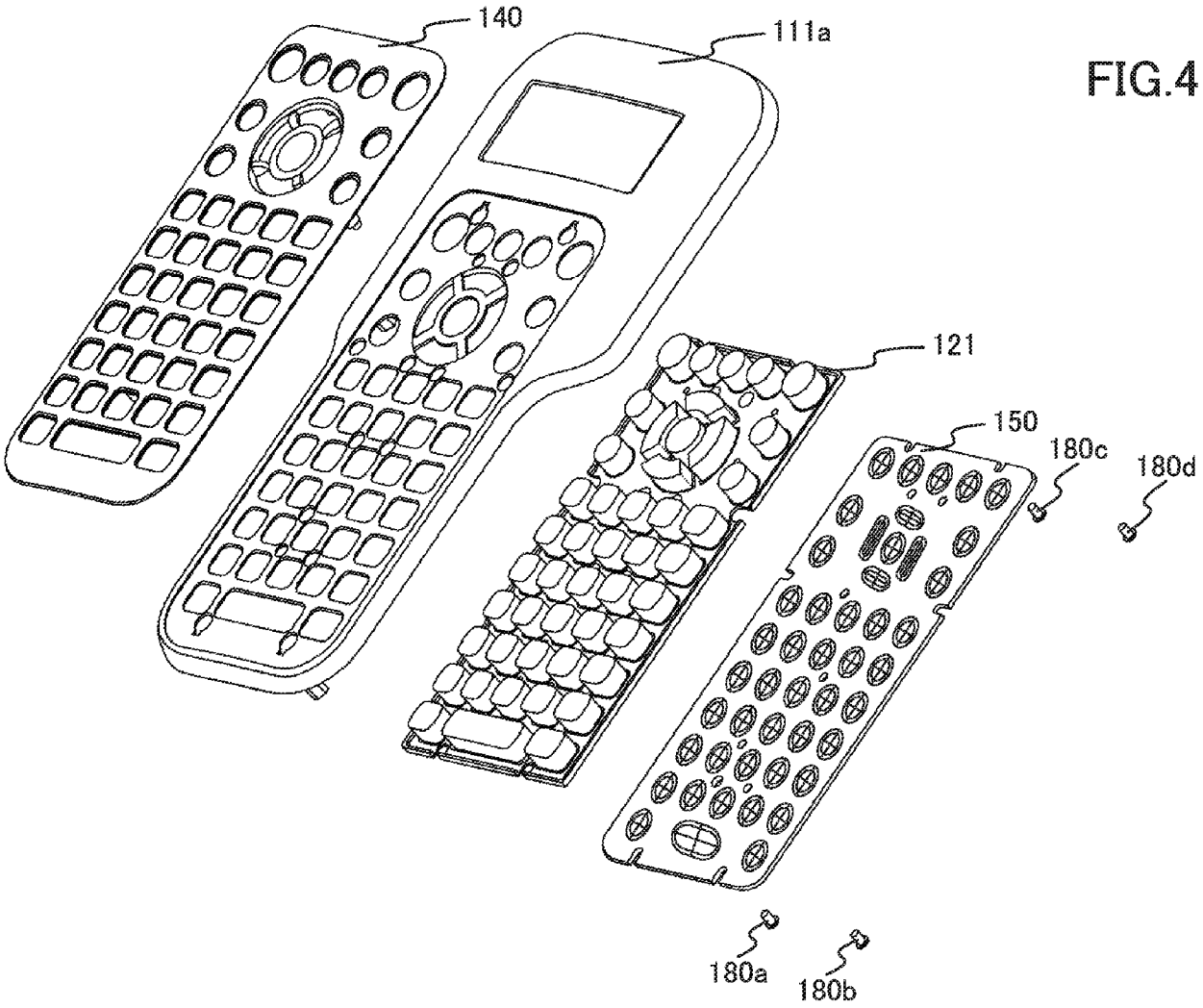
FIG. 4 is perspective views of a key cover, upper case, rubber key, and printed wiring board.

FIG. 4 shows an exploded view of the members fixed together with the upper case 111*a*. As shown in FIG. 4, the key cover 140 is placed on the front side of the upper case 111*a* (outside the enclosure 110) and a rubber key 121 and a printed writing board (PWB) 150 are placed on the back side of the upper case 111*a* (inside the enclosure 110). In other words, from the front side (outside) of the enclosure 110, the key cover 140, upper case 111*a*, rubber key 121, and printed wiring board 150 are superposed in sequence and fixed with four screws 180*a* to 180*d* that are common fixing members.

Figure 5A:
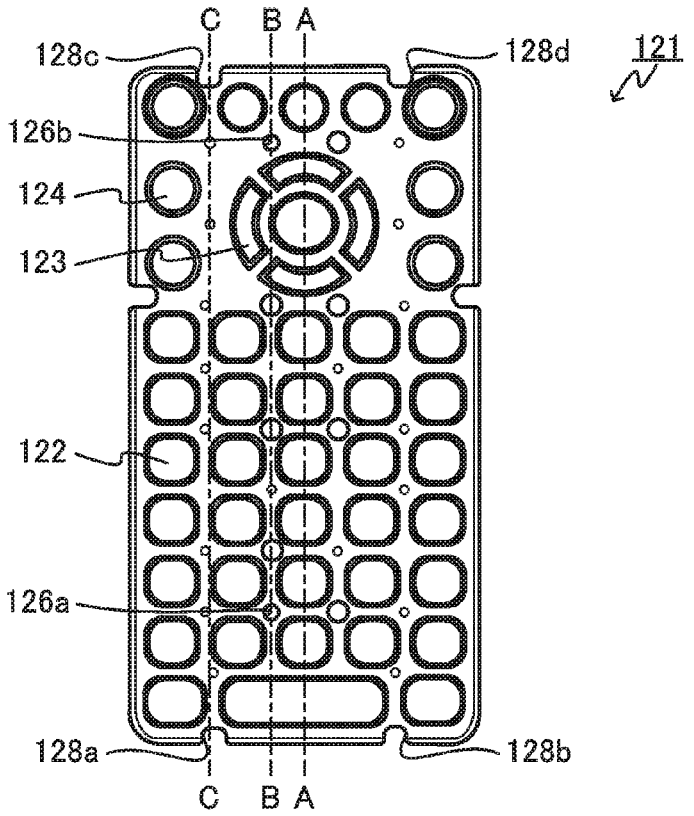
FIG. 5A is a plane view of the rubber key.

FIG. 5A shows the configuration of the rubber key 121. The rubber key 121 is a pressing member having plural protruding pressing parts arranged in a plane. As shown in FIG. 5A, the rubber key 121 has the press keys 122, 123, and 124 as the plural protruding pressing parts.

The press keys 122, 123 and 214 are, as described above, character input keys arranged in a grid, four cursor keys arranged in a circle and an enter key surrounded by these four cursor keys, and control keys so arranged as to surround the cursor keys and enter key, respectively. As each of the press keys 122, 123, and 124 is pressed by the user, the cap of the pressed key is pressed down under a load by the pressing and the contact of the cap makes contact with an electrode provided on the printed wiring board 150. Released from the pressing by the user, the cap of the pressed key returns to the ordinary position based on the elastic force of the rubber.

Moreover, openings 126*a* and 126*b* and notches 128*a* to 128*d* are formed in the rubber key 121.

The openings 126*a* and 126*b* are circular positioning holes (pinholes) into which positioning pins 146*a* and 146*b* provided on the key cover 140 (described in detail later) are inserted, respectively. The opening 126*a* is provided between the press keys 122 arranged in a grid, namely at a position where two grid lines (grids) intersect, in the lower region of the rubber key 121 in the longitudinal direction. On the other hand, the opening 126*b* is provided between the press keys 123 arranged in a circle and the press keys 124 surrounding the press keys 123 in the upper region of the rubber key 121 in the longitudinal direction. In the following explanation, openings 116*a* and 116*b* formed in the upper case 111*a* (described in detail later) are called third openings 116*a* and 116*b*, respectively, and the openings 126*a* and 126*b* formed in the rubber key 121 are called fourth openings 126*a* and 126*b*, respectively.

The notches 128*a* to 128*d* are patterns formed for fixing the rubber key 121. In more detail, two notches 128*a* and 128*b* are provided at the lower end of the rubber key 121 and two notches 128*c* and 128*d* are provided at the upper end of the rubber key 121. Protrusions 148*a* to 148*d* provided on the key cover 140 (described in detail later) are inserted into the four notches 128*a* to 128*d*, respectively.

Figure 5B:
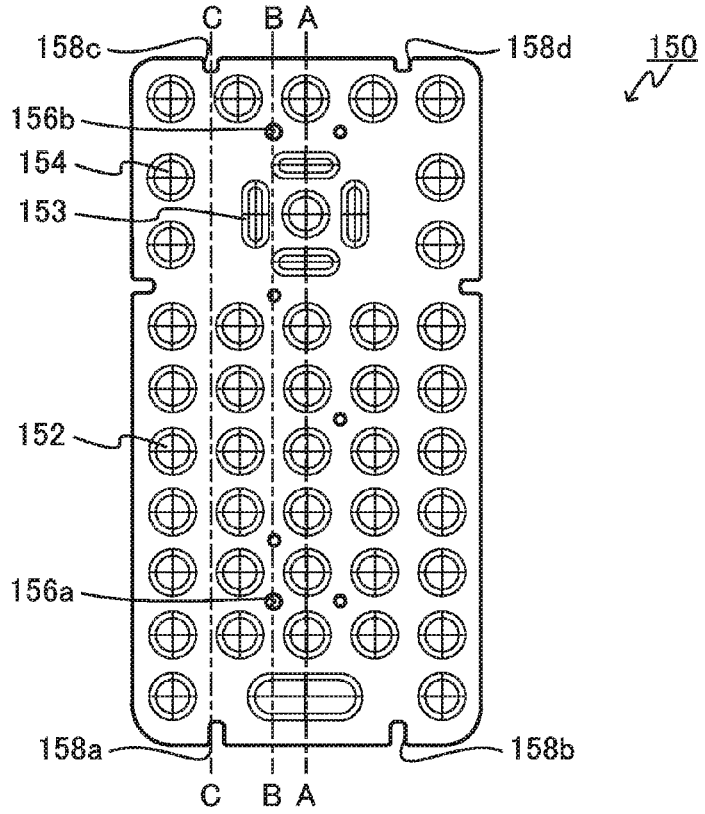
FIG. 5B is a plane view of the printed wiring board.

FIG. 5B shows the configuration of the printed wiring board 150. The printed wiring board 150 is a signals processing member having circuits processing signals generated when the press keys 122, 123, and 124 are pressed and having fifth openings formed. As shown in FIG. 5B, the printed wiring board 150 has electrodes 152, 153, and 154 on the surface faced with the rubber key 121 (namely, the front).

The electrodes 152, 153, and 154 correspond to the press keys 122, 123, and 124 on a one-to-one basis and are arranged in the same manner as the press keys 122, 123, and 124 provided on the rubber key 121. In more detail, the electrodes 152 are arranged in a grid in the lower to center region of the printed wiring board 150 in the longitudinal direction like the press keys 122 that are character input keys. The electrodes 153 include four electrodes arranged in a circle and an electrode surrounded by these four electrodes like the press keys 123 that are cursor keys and an enter key. The electrodes 154 are so arranged as to surround the electrodes 153 arranged in a circle like the press keys 124 that are control keys.

As each of the press keys 122, 123, and 124 provided on the rubber key 121 is pressed, the cap of the key pressed down by the pressing makes contact with the corresponding electrode on the printed wiring board 150. As the cap of the key makes contact with the electrode, a control signal corresponding to the pressed key is generated and output from the wire connected to the electrode.

Moreover, openings 156*a* and 156*b* and notches 158*a* to 158*d* are formed in the printed wiring board 150.

The openings 156*a* and 156*b* are circular positioning holes (pinholes) into which the positioning pins 146*a* and 146*b* provided on the key cover 140 (described in detail later) are inserted, respectively. The openings 156*a* and 156*b* are so positioned as to align with the fourth openings 126*a* and 126*b* formed in the rubber key 121, respectively. In more detail, the opening 156*a* is provided between the electrodes 152 arranged in a grid, namely at a position where two grid lines (grids) intersect, in the lower region of the printed wiring board 150 in the longitudinal direction. On the other hand, the opening 156*b* is provided between the electrodes 153 arranged in a circle and the electrodes 154 surrounding the electrodes 153 in the upper region of the printed wiring board 150 in the longitudinal direction. In the following explanation, the openings 156*a* and 156*b* are called fifth openings 156*a* and 156*b*, respectively.

The notches 158*a* to 158*d* are patterns formed for fixing the printed wiring board 150. The four notches 158*a* to 158*d* are so positioned as to align with the four notches 128*a* to 128*d* formed in the rubber key 121. In more detail, two notches 158*a* and 158*b* are provided at the lower end of the printed wiring board 150 and two notches 158*c* and 158*d* are provided at the upper end of the printed wiring board 150. The protrusions 148*a* to 148*d* provided on the key cover 140 (described in detail later) are inserted into the notches 158*a* to 158*d*, respectively.

Figure 6:
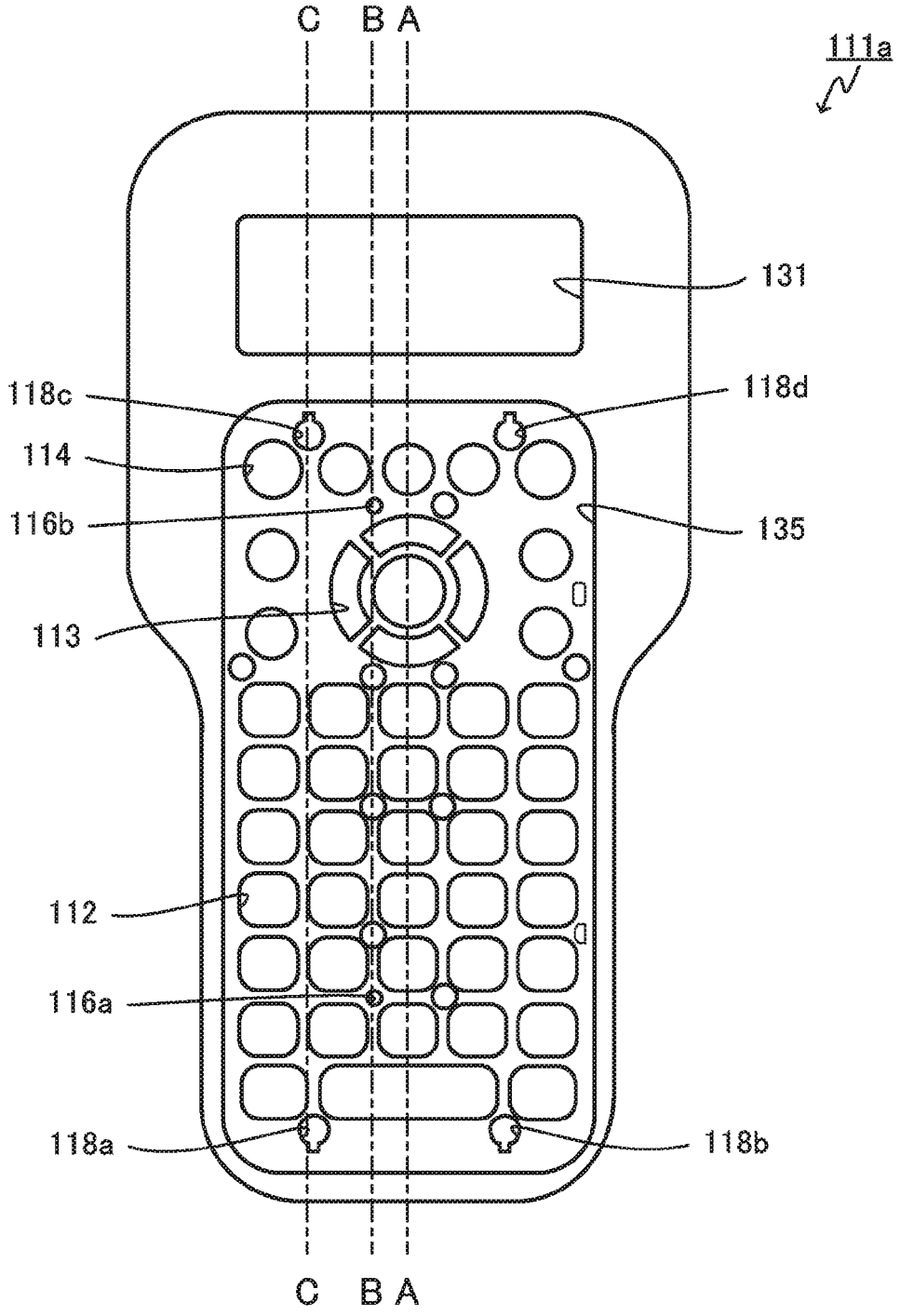
FIG. 6 is a plane view of the upper case.

FIG. 6 shows the configuration of the upper case 111*a*. The upper case 111*a* is a member constituting a part of the enclosure 110 of the printing device 100 as described above. Moreover, the upper case 111*a* is a first opening-formed member in which plural openings including openings 112, 113, and 114 are formed as shown in FIG. 6.

The openings 112, 113, and 114 are formed in a recess 135 formed in a surface of the upper case 111*a*. The openings 112, 113, and 114 are each a hole into which the corresponding press key is inserted among the press keys 122, 123, and 124 that are plural protruding pressing parts provided on the rubber key 121. Therefore, the openings 112, 113, and 114 correspond to the press keys 122, 124, and 124 on a one-to-one basis and are arranged in the same manner as the press keys 122, 123, and 124. In more detail, the openings 112 are formed in a grid in the lower region of the upper case 111*a* in the longitudinal direction like the press keys 122 that are character input keys. The openings 113 include four openings arranged in a circle and an opening surrounded by these four openings like the press keys 123 that are cursor keys and an enter key. The openings 114 are so formed as to surround the openings 113 arranged in a circle like the press keys 124 that are control keys. In the following explanation, the openings 112, 113, and 114 are called first openings 112, 113, and 114, respectively.

The first openings 112, 113, and 114 each have the same shape as the corresponding press key. Then, the first openings 112, 113, and 114 are each nearly equal or slightly larger in size (diameter) to or than the corresponding press key so that the inserted, corresponding press key can smoothly move up and down due to pressing operations of the user.

In addition to the above-described first openings 112, 113, and 114 into which the press keys 122, 123, and 124 are inserted, openings 116*a* and 116*b* and openings 118*a* to 118*d* are formed within the recess 135 formed in the upper case 111*a*.

The openings 116*a* and 116*b* are circular positioning holes (pinholes) into which the positioning pins 146*a* and 146*b* provided on the key cover 140 (described in detail later) are inserted, respectively. The openings 116*a* and 116*b* are so positioned as to align with the fourth openings 126*a* and 126*b* formed in the rubber key 121. In more detail, the opening 116*a* is provided between the openings 112 formed in a grid, namely at a position where two grid lines (grid) intersect, in the lower region of the upper case 111*a* in the longitudinal direction. On the other hand, the opening 116*b* is provided between the openings 113 arranged in a circle and the openings 114 surrounding the openings 113 in the upper region of the upper case 111*a* in the longitudinal direction. In the following explanation, the openings 116*a* and 116*b* are called third openings 116*a* and 116*b*, respectively.

The openings 118*a* to 118*d* are holes formed for fixing the upper case 111*a*. The four openings 118*a* to 118*d* are so positioned as to align with the four notches 128*a* to 128*d* formed in the rubber key 121. In more detail, two openings 118*a* and 118*b* are provided at the lower end of the recess 135 and two openings 118*c* and 118*d* are provided at the upper end of the recess 135. The protrusions 148*a* to 148*d* provided on the key cover 140 (described in detail later) are inserted into the four openings 118*a* to 118*d*, respectively.

Moreover, an opening 131 for the display 130 is formed in the upper part of the upper case 111*a* in the longitudinal direction. A liquid crystal display panel or the like constituting the display 130 is inserted into the opening 131. The user can view various displayed images displayed on the display 130 through the opening 131.

Figure 7A:
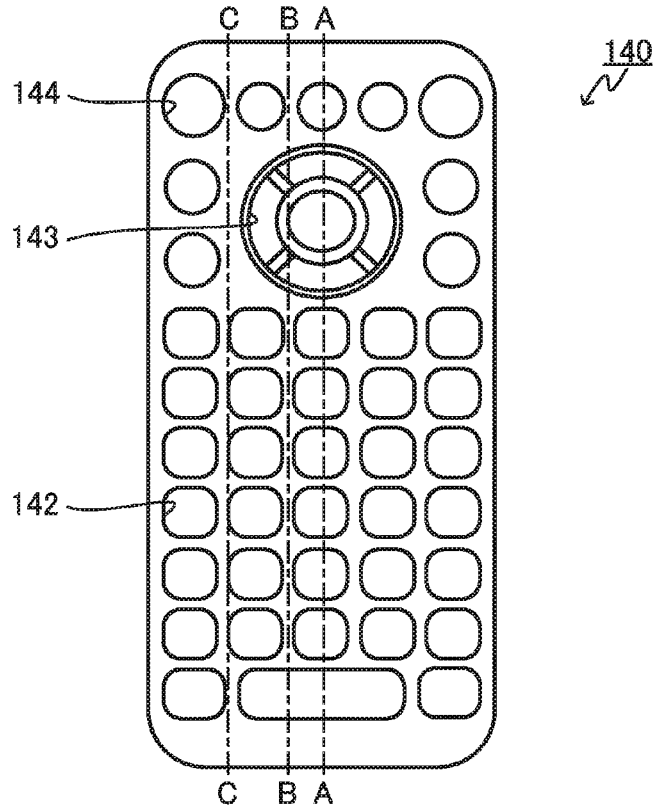
FIG. 7A is a plane view of the key cover seen from the front side.
Figure 7B:
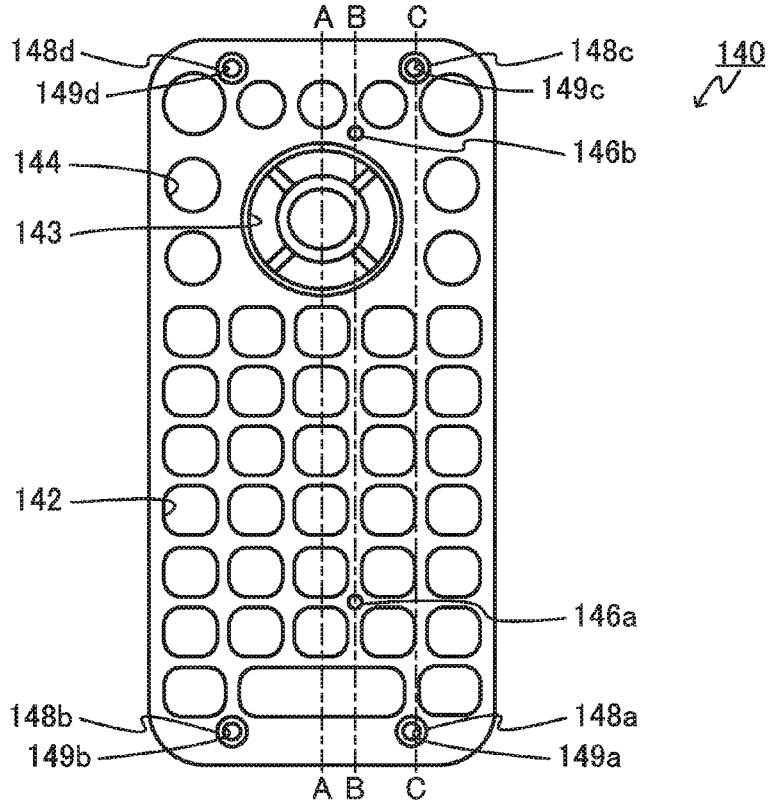
FIG. 7B is a plane view of the key cover seen from the back side.

FIGS. 7A and 7B show the configuration of the key cover 140. The key cover 140 is a member housed in the recess (dent) 135 formed in a surface of the upper case 111*a* and covering the surface of the upper case 111*a* in part.

Housed in the recess 135 of the upper case 111*a*, the key cover 140 covers a portion of the upper case 111*a* where the first openings 112, 113, and 114 are formed. The portion where the first openings 112, 113, and 114 are formed tends to receive a load due to pressing operations of the user. Therefore, the key cover 140 covers the upper case 111*a* to create a double-layer structure, thereby improving the strength.

Moreover, although presented colorless in the figure for avoiding intricacy, it is possible to make the key cover 140 different in color from the upper case 111*a* so as to improve the printing device 100 in design (industrial design). In other words, the key cover 140 and upper case 111*a* are generally produced by metal molding such as injection molding and therefore it is difficult to produce one and the same member having plural colors. Providing the key cover 140 as a separate member in addition to the upper case 111*a* easily makes it possible to present the appearance of the printing device 100 in plural different colors.

Furthermore, the key cover 140 can be used to hide poor appearance of the upper case 111*a* for improvement in design. For example, a port (gate) for introducing resin in the metal molding is often provided in the center of the molded article (around the area where the first openings 112, 113, and 114 are formed in the case of the upper case 111*a*) and easily causes poor appearance. Therefore, the key cover 140 covering the upper case 111*a* can make invisible the poor appearance of the upper case 111*a* that has occurred in the course of production.

The configuration of the key cover 140 will be described in detail hereafter. The key cover 140 is a second opening-formed member in which plural openings including openings 142, 143, and 144 are formed as shown in FIG. 7A.

The openings 142, 143, and 144 are each a hole into which the corresponding press key is inserted among the press keys 122, 123, and 124 that are plural protruding pressing parts provided on the rubber key 121. Therefore, the openings 142, 143, and 144 correspond to the press keys 122, 123, and 124 on a one-to-one basis and are arranged in the same manner as the press keys 122, 123, and 124. In more detail, the openings 142 are formed in a grid in the lower to center region of the key cover 140 in the longitudinal direction like the press keys 122 that are character input keys. The openings 143 include four openings arranged in a circle and an opening surrounded by these four openings like the press keys 123 that are cursor keys and an enter key. The openings 144 are so formed as to surround the openings 143 arranged in a circle like the press keys 124 that are control keys. In the following explanation, the openings 142, 143, and 144 are called second openings 142, 143, and 144, respectively.

The second openings 142, 143, and 144 are so positioned as to align with the first openings 112, 113, and 114 formed in the upper case 111*a*, respectively. Therefore, after the key cover 140 is superposed on the upper case 111*a* and fixed, the press keys 122, 123, and 124 protruding from the openings 112, 113, and 114 formed in the upper case 111*a* are inserted into the second openings 142, 143, and 144. In other words, the press keys 122, 123, and 124 each pass through two openings, the corresponding opening among the first openings 112, 113, and 114 formed in the upper case 111*a* and the corresponding opening among the second openings 142, 143, and 144 formed in the key cover 140.

The second openings 142, 143, and 144 each have the same shape as the corresponding press key. Then, the second openings 142, 143, and 144 are each nearly equal or slightly larger in size (diameter) to or than the corresponding press key so that the inserted, corresponding press key can smoothly move up and down due to pressing operations of the user.

Moreover, the key cover 140 has positioning pins 146*a* and 146*b* and protrusions 148*a* to 148*d* on the back as shown in FIG. 7B.

The positioning pins 146*a* and 146*b* are common positioning members that are positioning protrusions protruding from the back of the key cover 140 in the direction perpendicular to the back and serve for collectively positioning the key cover 140, upper case 111*a*, rubber key 121, and printed wiring board 150.

The positioning pins 146*a* and 146*b* are provided at positions corresponding to the third openings 116*a* and 116*b* formed in the upper case 111*a*, the fourth openings 126*a* and 126*b* formed in the rubber key 121, and the fifth openings 156*a* and 156*b* formed in the printed wiring board 150. In more detail, the positioning pin 146*a* is provided between the openings 142 formed in a grid, namely at a position where two grid lines (grids) intersect, in the lower region of the key cover 140 in the longitudinal direction. On the other hand, the positioning pin 146*b* is provided between the openings 143 arranged in a circle and the openings 144 surrounding the openings 143 in the upper region of the key cover 140 in the longitudinal direction.

The positioning pin 146*a* is inserted into the third opening 116*a* formed in the upper case 111*a*, the fourth opening 126*a* formed in the rubber key 121, and the fifth opening 156*a* formed in the printed wiring board 150. The positioning pin 146*b* is inserted into the third opening 116*b* formed in the upper case 111*a*, the fourth opening 126*b* formed in the rubber key 121, and the fifth opening 156*b* formed in the printed wiring board 150. As a result, four members, the key cover 140, upper case 111*a*, rubber key 121, and printed wiring board 150, are collectively positioned so as not to shift in the longitudinal direction and in the width direction of the printing device 100. Here, the third opening 116*a*, fourth opening 126*a*, and fifth opening 156*a* have the same shape as the corresponding positioning pin 146*a* and are each nearly equal in size (diameter) to the corresponding positioning pin 146*a* so as to be precisely positioned as the corresponding positioning pin 146*a* is inserted. Moreover, the third opening 116*b*, fourth opening 126*b*, and fifth opening 156*b* have the same shape as the corresponding positioning pin 146*b* and are each nearly equal in size (diameter) to the corresponding positioning pin 146*b* so as to be precisely positioned as the corresponding positioning pin 146*b* is inserted.

The protrusions 148*a* to 148*d* are fixing protrusions. The four protrusions 148*a* to 148*d* are provided at positions corresponding to the openings 118*a* to 118*d* formed in the upper case 111*a*, the four notches 128*a* to 128*d* formed in the rubber key 121, and the four notches 158*a* to 158*d* formed in the printed wiring board 150. In more detail, two protrusions 148*a* and 148*b* are provided at the lower end of the key cover 140 and two protrusions 148*c* and 148*d* are provided at the upper end of the key cover 140.

Screw holes 149*a* to 149*b* having a threaded inner surface are formed in the protrusions 148*a* and 148*d*, respectively. Four screws 180*a* to 180*d* that are common fixing members are inserted into the four screw holes 149*a* to 149*d*, respectively.

In more detail, with the four protrusions 148*a* to 148*d* provided on the key cover 140 being inserted into the openings 118*a* to 118*d* of the upper case 111*a*, the notches 128*a* to 128*d* of the rubber key 121, and the notches 158*a* to 158*d* of the printed wiring board 150, the four screws 180*a* to 180*d* having a threaded outer surface are inserted into the screw holes 149*a* to 149*d* from more inside than the printed wiring board 150 and fastened. As a result, four members, the key cover 140, upper case 111*a*, rubber key 121, and printed wiring board 150, are fixed (fastened) by a small number of fixing members, namely four screws 180*a* to 180*d*. Here, inserted into the openings 118*a* to 118*d* of the upper case 111*a*, the notches 128*a* to 128*d* of the rubber key 121, and the notches 158*a* to 158*d* of the printed wiring board 150, the four protrusions 148*a* to 148*d* provided on the key cover 140 also serve for further positioning the four members, the key cover 140, upper case 111*a*, rubber key 121, and printed wiring board 150.

The cross-sectional configuration of the key cover 140, upper case 111*a*, rubber key 121, and printed wiring board 150 configured as described above will be described with reference to FIGS. 8A to 10B.

Figure 8A:
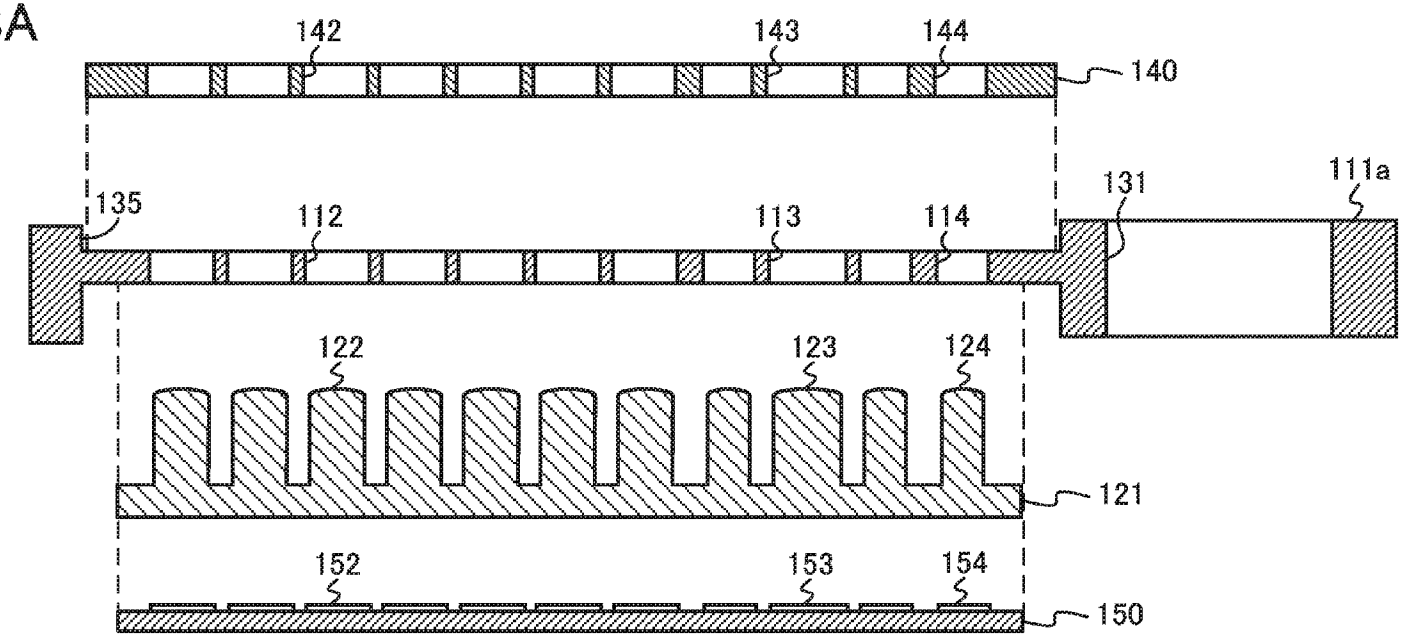
FIG. 8A is cross-sectional views of the key cover, upper case, rubber key, and printed wiring board at the line A-A shown in FIGS. 5A to 7B.

FIG. 8A shows individual cross-sectional views of the key cover 140, upper case 111*a*, rubber key 121, and printed wiring board 150 at the line A-A situated in the center of each member in the width direction. On the other hand, FIG. 9A shows individual cross-sectional views of these four members at the line B-B passing through the two positioning pins 146*a* and 146*b* provided on the key cover 140. Moreover, FIG. 10A shows individual cross-sectional views of these four members at the line C-C passing through the two protrusions 148*a* and 148*c* among the four protrusions 148*a* to 148*d* provided on the key cover 140. For avoiding intricacy and easier understanding, FIGS. 8A to 10B show only the cross-sectional configurations of the members at the lines (A-A, B-B, and C-C) and the configurations supposed to be seen far off (behind) the cross-section are eliminated. Moreover, FIGS. 8A to 10B show the cross sections with hatching and the openings and notches in contour.

As shown in FIGS. 8A, 9A, and 10A, from the front side (outside) of the enclosure 110, the key cover 140, upper case

111*a*, rubber key 121, and printed wiring board 150 are superposed in this order and assembled into a single fixed article.

A specific assembling process (production method) will be described in the following (1) to (4).

(1) First, the key cover 140 is fitted in the recess 135 of the upper case 111*a*. At this point, the positioning pins 146*a* and 146*b* provided on the key cover 140 are passed through the third openings 116*a* and 116*b* of the upper case 111*a*, respectively. As a result, the corresponding openings between the first openings 112, 113, and 114 of the upper case 111*a* and the second openings 142, 143, and 144 of the key cover 140 align with each other with high accuracy. Moreover, at this point, the fixing protrusions 148*a* to 148*d* provided on the key cover 140 are inserted into the openings 118*a* to 118*d* of the upper case 111*a*, respectively.

(2) Secondly, the press keys 122, 123, and 124 provided on the rubber key 121 are passed through the first openings 112, 113, and 114 of the upper case 111*a* and the second openings 142, and 143, and 144 of the key cover 140, which are in the superposed state, whereby the rubber key 121 is attached to the upper case 111*a*. At this point, the positioning pins 146*a* and 146*b* passed through the third openings 116*a* and 116*b* are further passed through the fourth openings 126*a* and 126*b* of the rubber key 121, respectively. As a result, the press keys 122, 123, and 124, the first openings 112, 113, and 114, and the second openings 142, 143, and 144 are positionally aligned with high accuracy. Moreover, at this point, the fixing protrusions 148*a* to 148*d* are inserted into the notches 128*a* to 128*d* of the rubber key 121, respectively.

(3) Thirdly, the printed wiring board 150 is attached to the rubber key 121 so that the press keys 122, 123, and 124 are each superposed on the corresponding electrode among the electrodes 152, 153, and 154 provided on the printed wiring board 150. At this point, the positioning pins 146*a* and 146*b* passed through the third openings 116*a* and 116*b* and fourth openings 126*a* and 126*b* are further passed through the fifth openings 156*a* and 156*b* formed in the printed wiring board 150, respectively. As a result, the printed wiring board 150 can be precisely positioned with respect to the other members. Moreover, at this point, the fixing protrusions 148*a* to 148*d* are inserted into the notches 158*a* to 158*d* of the printed wiring board 150, respectively.

(4) Fourthly, in the state of being positioned by the positioning pins 146*a* and 146*b*, the screws 180*a* to 180*d* are inserted into the screw holes 149*a* to 149*d* of the protrusions 148*a* to 148*d*, respectively, and fastened. Fastening the screws 180*a* to 180*d* results in applying a force fastening the members in the direction perpendicular to their surfaces. Consequently, the key cover 140, upper case 111*a*, rubber key 121, and printed wiring board 150 are fixed.

Figure 8B:
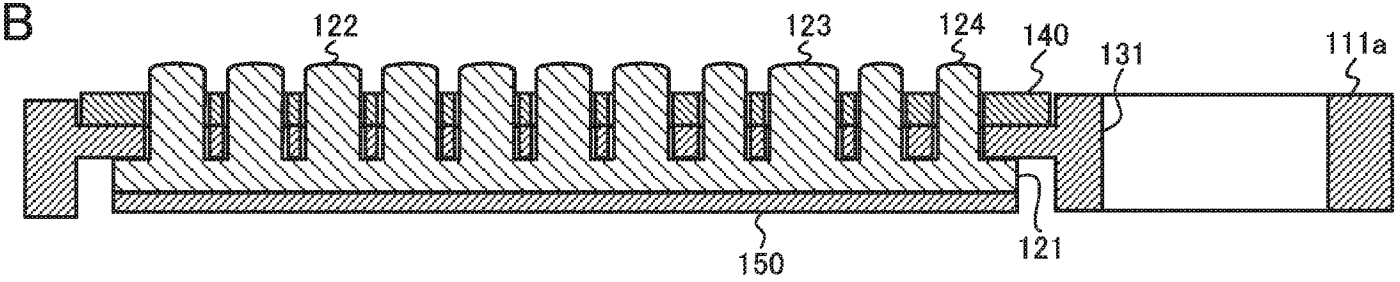
FIG. 8B is a cross-sectional view of the four members shown in FIG. 8A after assembled.
Figure 9A:
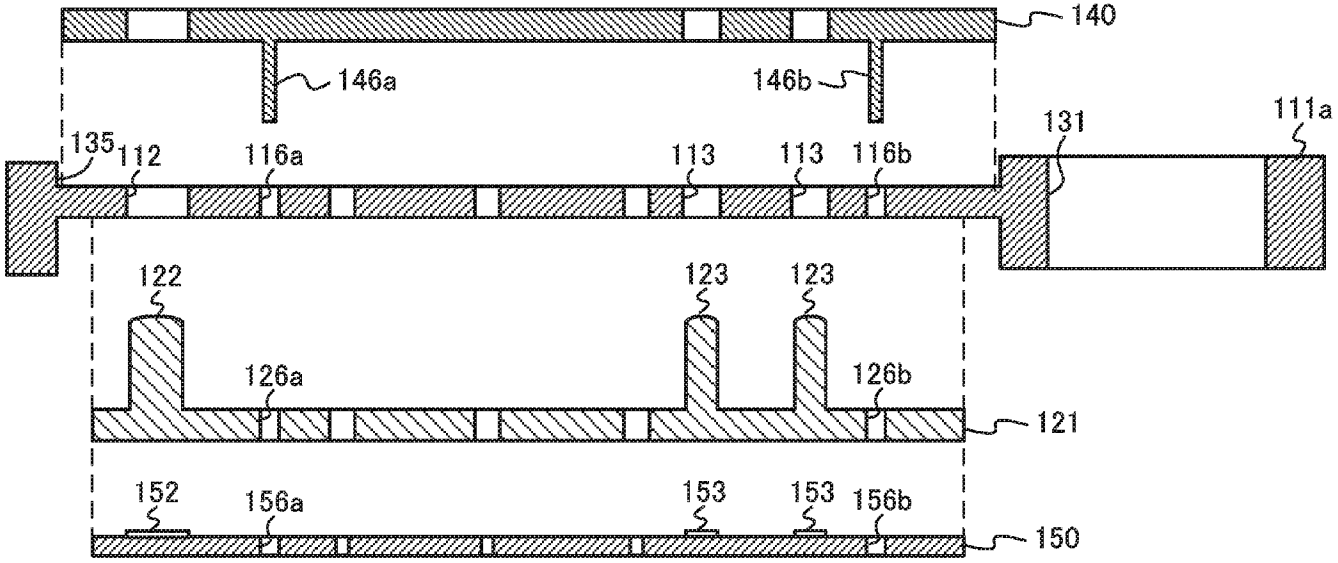
FIG. 9A is cross-sectional views of the key cover, upper case, rubber key, and printed wiring board at the line B-B shown in FIGS. 5A to 7B.
Figure 9B:
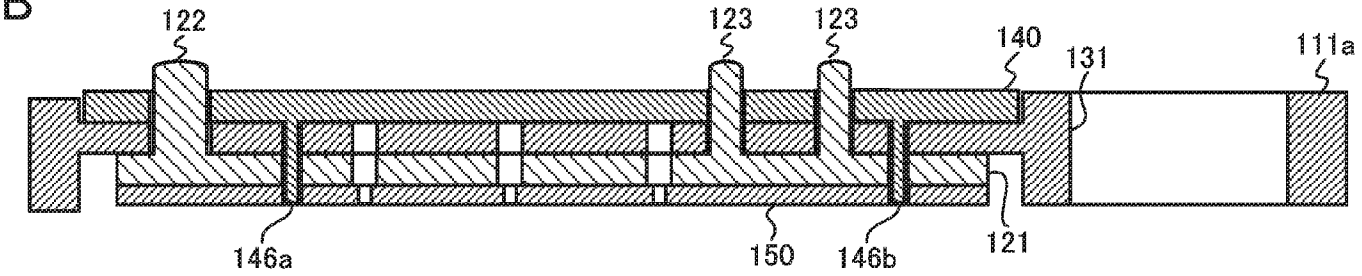
FIG. 9B is a cross-sectional view of the four members shown in FIG. 9A after assembled.
Figure 10A:
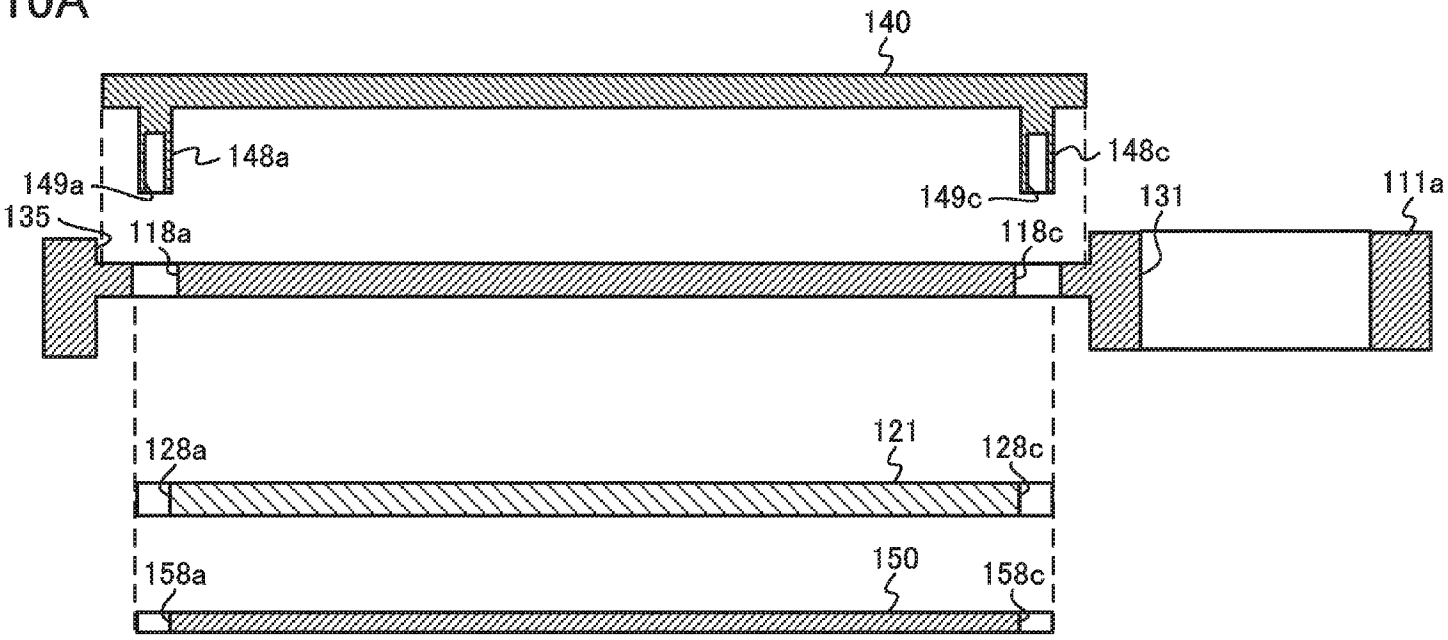
FIG. 10A is cross-sectional views of the key cover, upper case, rubber key, and printed wiring board at the line C-C shown in FIGS. 5A to 7B.
Figure 10B:
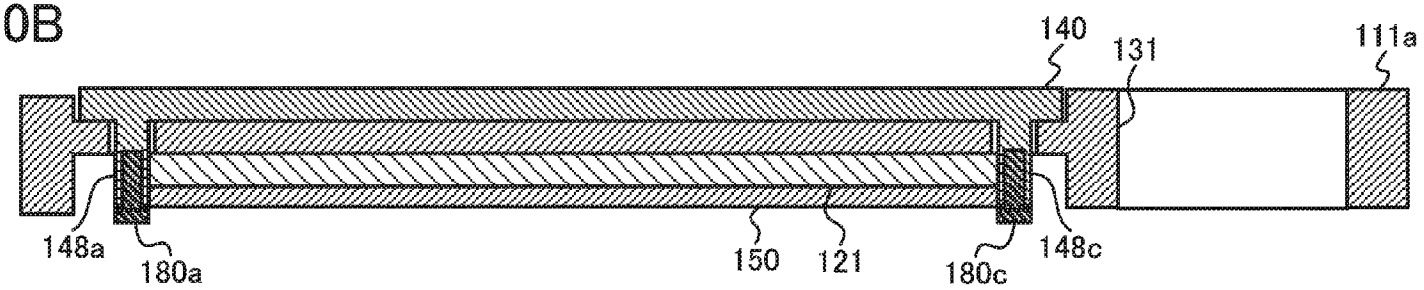
FIG. 10B is a cross-sectional view of the four members shown in FIG. 10A after assembled.

As a result of the four members being superposed in sequence as described above, the key cover 140, upper case 111*a*, rubber key 121, and printed wiring board 150 are assembled as shown in FIGS. 8B, 9B, and 10B.

As shown in FIG. 8B, after assembled, the press keys 122, 123, and 124 provided on the rubber key 121 are inserted in both the first openings 112, 113, and 114 formed in the upper case 111*a* and the second openings 142, 143, and 144 formed in key cover 140, and protrude from the surface of the key cover 140 to a given height so that the user can easily press the press keys 122, 123, and 124.

Moreover, as shown in FIG. 9B, the positioning pins 146*a* and 146*b* provided on the key cover 140 are inserted in the upper case 111*a*, rubber key 121, and printed wiring board 150 at the same time. Therefore, the four members are positioned with reference to the positioning pins 146*a* and 146*b* that are common positioning members. Consequently, the four members can be positioned with high accuracy.

In other words, for example, if a member for positioning the key cover 140 and upper case 111*a* and a member for positioning the upper case 111*a* and rubber key 121 are separate members, the key cover 140 and rubber key 121 are positioned only indirectly, whereby a larger positioning error may occur. Moreover, a larger number of fixing members such as screws are required. Therefore, it is difficult in a relatively small device such as the printing device 100 according to this embodiment to smoothly insert each of the press keys 122, 123, and 124 arranged closely in a small region into the two openings formed in the upper case 111*a* and key cover 140.

In order to prevent the above problem, for example, a large opening into which the press keys 122, 123, and 214 are inserted all together may be formed instead of openings corresponding to the press keys 122, 123, and 144 on a one-to-one basis such as the first openings 112, 113, and 114 of the upper case 111*a*. As a result, the press keys 122, 123, and 124 are each inserted into only one opening, whereby the accuracy of positioning is not required compared to the case of being inserted into two openings. However, if a large opening is formed in the portion of the upper case 111*a* where the press keys 122, 123, and 124 are inserted, the strength of the enclosure 110 is lowered.

In the printing device 100 according to this embodiment, the positioning pins 146*a* and 146*b* that are common positioning members are used for positioning, whereby the press keys 122, 123, and 124 can each be inserted into both two openings formed in the upper case 111*a* and key cover 140 with excellent accuracy. Consequently, with the key cover 140 covering the portion of the upper case 111*a* where the first openings 112, 113, and 114 are formed, which is likely to receive a load due to pressing operations of the user, the strength of the printing device 100 can be improved. Moreover, using the key cover 140 different in color from the upper case 111*a*, the printing device 100 can be improved in design (industrial design).

Furthermore, in the printing device 100 according to this embodiment, accurate positioning by the common positioning members makes it possible to insert the protrusions 148*a* to 148*d* provided on the key cover 140 into the upper case 111*a*, rubber key 121, and printed wiring board 150 at the same time as shown in FIG. 10B. Therefore, in the printing device 100 according to this embodiment, the four members, the key cover 140, upper case 111*a*, rubber key 121, and printed wiring board 150, can collectively be fixed with a small number of fixing members, namely four screws 180*a* to 180*d*.

Modified Embodiments

An embodiment of the present disclosure is described above. The above-described embodiment is given by way of example and the scope of application of the present disclosure is not confined to this embodiment. In other words, the embodiment of the present disclosure is applicable in a variety of manners and any mode of implementation is included in the scope of the present disclosure.

For example, in the above-described embodiment, the electronic device according to the present disclosure is the printing device 100 that is a label printer by way of example. However, the electronic device according to the present disclosure is not confined to printing devices such as label printers. The electronic device according to the present disclosure may be, for example, an electronic dictionary, desk calculator, cell-phone, some other computer, or the like as long as the device has protruding pressing parts such as keys, buttons, or the like.

Moreover, in the above-described embodiment, the pressing member is the rubber key 121 by way of example. However, the pressing member in the present disclosure may be made of some materials other than rubber such as synthetic resin as long as the pressing member has protruding pressing parts.

Moreover, in the above-described embodiment, the rubber key 121 that is the pressing member has plural press keys 122, 123, and 124 arranged in a plane as the pressing parts. However, as long as arranged in a surface, the plural pressing parts in the present disclosure may be arranged in a curved surface, not in a completely two-dimensional plane. For example, where an electronic device includes an enclosure having a curved surface and the pressing member is accordingly curved, the plural pressing parts are arranged in a curved surface.

Moreover, the pressing member in the present disclosure may have only one pressing part, not plural pressing parts. Even where the pressing member has only one pressing part, with the pressing member and plural opening-formed members being positioned by the common positioning members as in the above-described embodiment, the pressing part can be inserted into plural openings with excellent accuracy. In this regard, where plural pressing parts are arranged closely in a small region as in the case of plural pressing parts being arranged in a grid in a small device, there is no dimensional allowance (margin) for plural openings into which the plural pressing parts are inserted; therefore, the pressing parts and openings have to be positioned with higher accuracy. Thus, the efficacy of the present disclosure is enhanced where the pressing member has plural pressing parts arranged closely.

Moreover, in the above-described embodiment, the positioning pins 146*a* and 146*b* are provided to the key cover 140 that is the outermost member of the printing device 100. However, in the present disclosure, it may be possible to provide on the printed wiring board 150 or rubber key 121, which are inner members of the printing device 100, positioning pins protruding outward and form in the key cover 140 openings into which the positioning pins are inserted. In such a case, with the positioning pins provided on the printed wiring board 150 or rubber key 121 being inserted into the openings formed in the upper case 111*a* and key cover 140, the four members are mutually positioned. Similarly, it may be possible to provide the fixing protrusions 148*a* to 148*d* provided on the key cover 140 in the above-described embodiment on the printed wiring board 150 or rubber key 121, which are inner members of the printing device 100. In this regard, providing openings in the outermost member of the printing device 100 leads to impairing the appearance of the printing device 100 in design. Therefore, it is preferable in consideration of design to provide on the key cover 140 the positioning pins 146*a* and 146*b* and protrusions 148*a* to 148*b* oriented inside of the printing device 100 as in the above-described embodiment.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. An electronic device comprising:

a pressing member including plural pressing parts;

a first opening-formed member including plural first openings in which the plural pressing parts are inserted so as to individually protrude out of the first openings;

a second opening-formed member including plural second openings in which the plural pressing parts inserted in the plural first openings are inserted so as to individually protrude out of the first openings and the second openings; and at least one positioning member which positions the pressing member, the first opening-formed member, and the second opening-formed member so that the plural pressing parts are disposed at positions where the plural pressing parts are inserted in the plural first openings and the plural second openings, wherein:

the first opening-formed member constitutes at least a part of an outside body of the electronic device, the second opening-formed member covers part of a surface of the first opening-formed member, the pressing member has a plurality of holes, the first opening-formed member has a plurality of holes corresponding to the plurality of holes of the pressing member, and the second opening-formed member covers the plurality of holes of the pressing member and the plurality of holes of the first opening-formed member.

2. The electronic device according to claim 1, wherein:

the second opening-formed member includes at least one positioning protrusion as the at least one positioning member, the first opening-formed member includes at least one third opening, the pressing member includes at least one fourth opening, and the pressing member, the first opening-formed member, and the second opening-formed member are positioned by the at least one positioning protrusion, the at least one positioning protrusion being inserted into the at least one third opening and the at least one fourth opening.

3. The electronic device according to claim 2, further comprising:

a signal processing member including circuits which process signals generated when at least one of the plural pressing parts is pressed, the signal processing member including at least one fifth opening, wherein the pressing member, the first opening-formed member, the second opening-formed member, and the signal processing member are positioned by the at least one positioning protrusion, the at least one positioning protrusion being inserted into the at least one third opening, the at least one fourth opening, and the at least one fifth opening.

4. The electronic device according to claim 3, wherein the pressing member, the first opening-formed member, the second opening-formed member, and the signal processing member are fixed by plural fixing members.

5. The electronic device according to claim 3, wherein:

the signal processing member further includes an electrode, the circuits of the signal processing member process signals generated when at least one of the plural pressing parts is pressed and a topper of the at least one pressed pressing part is pressed down under a load by the pressing and makes contact with the electrode of the signal processing member.

6. The electronic device according to claim 1, wherein the plural pressing parts are arranged in a plane.

7. The electronic device according to claim 1, wherein the pressing member, the first opening-formed member, and the second opening-formed member are fixed by plural fixing members.

8. The electronic device according to claim 1, wherein the second opening-formed member is placed in a recess formed at the surface of the first opening-formed member.

9. The electronic device according to claim 1, wherein the second opening-formed member is different in color from the first opening-formed member.

10. A printing device comprising:

the electronic device according to claim 1; and a printing mechanism which prints a print pattern on a printing medium according to data entered by an input part.

11. The printing device according to claim 10, further comprising:

a display which displays information regarding data entered by the input part.

12. An electronic device comprising:

a pressing member including plural pressing parts;

a first opening-formed member including plural first openings in which the plural pressing parts are inserted so as to individually protrude out of the first openings;

a second opening-formed member including plural second openings in which the plural pressing parts inserted in the plural first openings are inserted so as to individually protrude out of the first openings and the second openings; and at least one positioning member which positions the pressing member, the first opening-formed member, and the second opening-formed member so that the plural pressing parts are disposed at positions where the plural pressing parts are inserted in the plural first openings and the plural second openings, wherein the pressing member has a plurality of holes, wherein the first opening-formed member has a plurality of holes corresponding to the plurality of holes of the pressing member, and wherein the second opening-formed member covers the plurality of holes of the pressing member and the plurality of holes of the first opening-formed member.

* * * * *